United States Patent [19]

Tesch

[11] 4,433,018

[45] Feb. 21, 1984

[54] METHOD OF MANUFACTURING OF TEXTILE FLAT STRUCTURE AND TEXTILE WEB MANUFACTURED THEREBY

[75] Inventor: Günter Tesch, Fribourg, Switzerland

[73] Assignee: Breveteam S.A., Zug, Switzerland

[21] Appl. No.: 329,300

[22] Filed: Dec. 10, 1981

[30] Foreign Application Priority Data

Dec. 23, 1980 [CH] Switzerland ..... 9507/80

[51] Int. Cl.[3] ..... D04H 11/00; D05C 17/02

[52] U.S. Cl. ..... 428/89; 26/2 R; 28/107; 28/109; 156/72; 428/95

[58] Field of Search ..... 428/89, 95; 156/72; 26/2 R; 28/107, 109

[56] References Cited

U.S. PATENT DOCUMENTS 3,672,929 6/1972 Riordan ..... 428/89

FOREIGN PATENT DOCUMENTS 2452136 5/1976 Fed. Rep. of Germany .

*Primary Examiner*—Marion McCamish

*Attorney, Agent, or Firm*—Ernest F. Marmorek

[57] ABSTRACT

A textile flat structure is manufactured by needle processing of a pile yarn tufted into a carrier layer so that some pile loops of the pile yarn forming an upper layer are engaged by needles and their height and shape are changed, whereas at least one pile yarn is pulled toward the carrier layer, whereby a texture and/or pattern is produced. The textile flat structure has a carrier layer, a pile yarn tufted into the carrier layer and having pile loops at an upper side of the carrier layer and connecting base loops at a lower side thereof, whereas the pile loops forming an upper layer have at least non-uniform different heights.

31 Claims, 4 Drawing Figures

METHOD OF MANUFACTURING OF TEXTILE FLAT STRUCTURE AND TEXTILE WEB MANUFACTURED THEREBY

BACKGROUND OF THE INVENTION

The present invention relates to a method of manufacturing a textile flat structure with a texture and/or pattern at its upper side, in accordance with which a pile yarn is tufted into a carrier layer so that pile loops project from the upper side of the carrier layer and form an upper layer and base loops extend at the lower side of the carrier layer. The invention also relates to a textile flat structure manufactured by this method.

It is known to manufacture textured, patterned, textile flat structures in such a manner that the pile yarn with different pile heights is tufted into the carrier layer, so that the pile loops are arranged not at the same height and an embossed structure can be obtained. The pile heights are thereby uniformly different. In other words, the regions with identically low pile height alternate with the regions of high pile height. This uniform embossed structure is conditional of a predetermined arrangement or setting of the tufting device with the aid of which alternating regions with identically low pile loops and high pile loops can be obtained. The further disadvantage of this method is that the manufacturing of the different pile heights for obtaining a desired pattern and/or texture is coupled with the tufting process and therefore is connected not only with the tufting process itself, but also with the above-mentioned tufting device. A change of patterns thereby requires expensive rearrangements of the tufting process or its preparation and working conditions.

It is known from DE-OS No. 2,452,136 to manufacture an upper layer of pile loops by tufting a pile yarn into a carrier layer and needle individual fibers from a lower layer into free spaces of the upper layer through the carrier layer. In the event of the product having a low pile weight, the entire surface of the same must be coated. However, for complete filling of the free spaces by a great quantity of individual fibers, a very purposeful work is required. Possibilities of providing patterns of such textile flat surfaces are limited by properties of the needle-processed loosely projecting individual fibers which impart to the upper layer the appearance of a tip-shear article, or a loose pile article with a uniform structure.

SUMMARY OF THE INVENTION

Accordingly, it is an object of the present invention to provide a method of manufacturing a textile flat structure, which avoids the disadvantages of the prior art.

More particularly, it is an object of the present invention to provide a method of manufacturing a textile flat structure, in accordance with which a tufted product with a texture and/or pattern can be manufactured independently of already tufted material or expensive tufting processes, and in accordance with which a textile flat structure is obtained which can be textured and/or patterned at its upper side in many ways.

It is also an object of the present invention to provide a flat textile structure having the above mentioned features.

In keeping with these objects and with others which will become apparent hereinafter, one feature of the present invention resides, briefly stated, in a method in accordance with which a carrier layer is tufted with a pile yarn having pile loops projecting from an upper side and base loops extending at a lower side of the carrier layer, wherein the projecting pile yarns are changed with regard to their height and shape by needles pushed through the carrier layer and engaging the pile loops, whereas at least one pile loop connected with the engaged pile loops through the respective base loops is not engaged by the needles and drawn towards the carrier layer.

When the method is performed in accordance with the present invention, the changes of pile height and shape can be performed in a surprising manner subsequently on an already tufted product, and independently of a tufting process the textile flat structure can be provided with a texture and/or pattern, for example an embossed structure. In an advantageous manner, a non-uniform texture can be obtained by the inventive engagement of the pile loops, which cannot be obtained by the tufting alone. Particularly, the quality and character of the upper side of the tufted textile flat structure can be changed in a simple manner, namely by simple stitching of needles from the rear side of the carrier layer. The method thereby satisfies the requirements of obtaining different textures and/or patterns independently of the already tufted product.

In accordance with the invention, a textile flat structure with a pile yarn tufted into a carrier layer may be advantageously produced so that an upper layer with projecting pile loops is formed at the upper side of the carrier layer, and the pile loops of the upper layer have at least non-uniform different pile heights.

It is thereby a product is obtained, in which the different pile heights of the pile loops alternate non-uniformly and different pile heights are, for example, arbitrarily distributed, so that it can be said that there are "anarchically" arranged pile heights. The inventive textile flat fabric provides for a plurality of possibilities for use and is especially suitable for use as floor or wall coatings and decoration of furniture materials, where a tecture and/or pattern is desirable.

The engaged pile loops are, for example, increased in their height, whereas the non-engaged pile loops are, for example, reduced in their height. The different pile heights can be distributed over the upper layer of the flat structure non-uniformly, for example arbitrarily. At the same time, the non-engaged neighboring pile loops can also be pulled completely in or through the carrier layer so that an especially strong embossed non-uniform structure can be produced. Thus, a non-uniform structure can be obtained which, for example, is similar to a structure of a plyyarn as utilized for example for carpets. For increasing the pile height or changing the shape of pile loops, a feed of the pile yarn is required. A portion of the pile yarn can be pulled through the common base loop from at least one non-engaged pile loop, inasmuch as the pile loops are tufted withdrawable or non-fixed in the carrier layer and thereby lie free on the same.

The shape of the pile loops can be changed in a particularly advantageous manner by engagement with needles which can so engage the pile loops that they are torn, ribbed or roughended. In this manner, the pile loops can be made non-uniform in their shape, for example deformed so as to obtain further designs of the texture and/or pattern. It is possible to utilize such needles as felt needles with barbs or special felt needles, such as for example conventional sidehoc needles, fork needles or loop needles which can be received from "Singer Spezialnadelfabrik GmbH", D5102 Würselen. By piercing through the carrier layer, the pile loops can be engaged by these needles at any locations and thereby their pile height and shape can be changed. By the change of shape, for example, deformation of the pile loops, it is possible in the event of the pile yarns or synthetic fibers or filaments such as multifilaments, to eliminate the uniform appearance of the synthetic material and to provide the appearance of a natural yarn twined from fibers. After the needle processing, namely stitching the needles from the rear side, the pile loops can be bent in the lateral direction so that they assume substantially horizontal position. Thereby, a further texturing is produced. A further improvement of the texture can be obtained when the pile heights of the engaged pile loops are increased to a non-uniform length, so that a further deformation and/or anarchic arrangement can be obtained.

In dependence upon the density of needles, more or less pile loops can be engaged and the non-engaged pile loops can be drawn back. The pile loops can be engaged for example, with a needle-density of 5–80, preferably 20–30, stitched per square centimeter. It is possible to engage, for example, 20 to 30% of the pile loops per square meter of the flat structure. The textile flat structure can thereby possess 20–30% of the pile loops with a greater pile height than remaining pile loops. The pile loops with the greater pile height can have the above described non-uniform shape or design. The pile height of the pile loops can be increased for example, by 20–100% relative to their initial pile height. If the initial pile height is equal, for example, to 3 mm., then this pile height can be increased or elongated by the inventive method, for example, to 5–6 mm.

It is possible to start with a manufactured already tufted product and then to needle-process the same in accordance with the inventive method. The tufted product can therefore be stored in advantageous manner, and then treated in accordance with the inventive method for manufacturing of the patterned and/or textured textile flat structure. It is also possible to tuft the pile yarn into the carrier layer by successive working steps, and immediately thereafter to change the pile height and shape of the pile loops by the needle from the rear side of the carrier layer. This provides for the advantage in the fact that the textile flat structure in accordance with the present invention can be manufactured continuously at a manufacturing site. The tufted initial product can have the pile loops with equal or different pile heights which can be produced by the above described tufting process.

In accordance with another embodiment of the inventive method, after tufting the pile yarn into the carrier layer, a fiber material from a lower layer can be needle-forced through the carrier layer into the upper layer with the pile loops, so that after changing the pile height and shape at least some spaces in the upper layer can be filled with the thus needle-processed definite fiber structure. Thereby, a textile flat structure can be obtained, in which the pile loops are mixed with the definite fiber structures which are partially located in the lower layer and/or the carrier layer and can be anchored therein. Such a method and product is disclosed, for example, in a not published CH-PS which corresponds to CH patent application No. 9,506/80-5 filed on Dec. 23, 1980 for "Method of Manufacturing a Non-Woven Textile Flat Structure and Non-Woven Textile Flat Structure Manufactured Thereby", to which references are made herein. In this manner there is a further possibility for providing a texture and/or pattern which can also be colored when the definite fiber structures have another color than the material of the pile loops or colors differing from one another.

The definite fiber structure can be provided not only in the upper layer, namely between the pile loops, but also at its upper side or on the pile loops, so that to allow a plurality of possibilities for providing textures and/or patterns. In connection with this, the reference is again made to the above-mentioned CH-PS. The definite fiber structure can be needled through at locations of the pile loops with reduced pile height in the upper layer. Thereby an intended filling or completing of the low pile location is possible, which can be obtained by the reduced pile loops. It is thereby possible to obtain an optically strongly cut off structure and/or pattern.

In particular, ball yarns of spherically interwined fibers or threads as definite fiber structures can be introduced by needles into free spaces of the upper layer to be located therein. These free spaces can be present between the pile loops after the tufting process or can be first provided by needle-processing in accordance with the invention, by the needles. The needle-processing of the ball yarns carried out from the rear side can provide for point or dot-like patterns. The ball yarns are known, for example, from EP Publications 0013427 and 0013428 to which references are also made herein.

The invention can be understood from the following description of preferred embodiments which is accompanied by the drawings.

DESCRIPTION OF PREFERRED EMBODIMENTS

Figure 1:
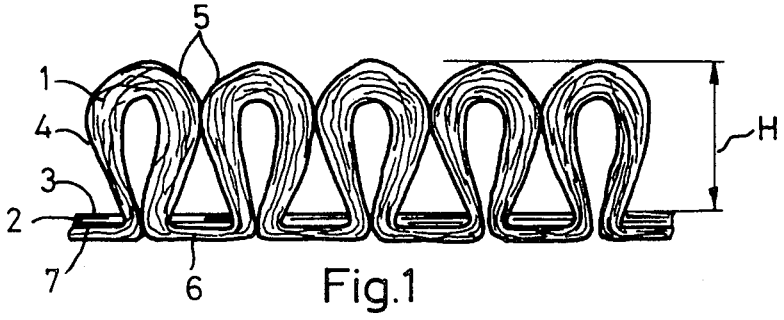
FIG. 1 is a large scale schematic sectional view showing a tufted textile flat structure.

A textile flat structure shown in FIG. 1 has a pile yarn 1 tufted into a carrier layer 2 so that an upper layer 4 with projecting pile loops 5 of an identical pile height H is formed at an upper side 3 of the carrier layer 2, and the pile loops 5 are connected with each other by base loops 6 at a lower side 7 of the carrier layer. Needles are inserted in the tufted product manufactured in the above mentioned known manner, from the lower side 7 through the carrier layer 2. The needles are arranged so that individual pile loops 5 are engaged or grasped by the needles and changed, particularly pushed from the carrier layer 2. A textile flat structure 8 shown in FIG. 2 is obtained by this needle-processing, wherein FIG. 2 has reference numerals identical to those of FIG. 1.

Figure 2:
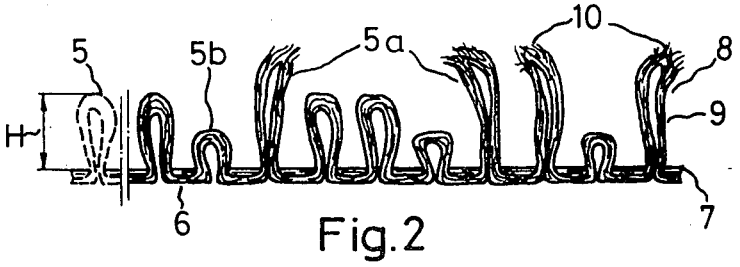
FIG. 2 is a view similar to FIG. 1, but showing the textile flat structure showing a modification with changed pile height.

Pile loops **5*a* engaged by the needles are increased in their height, namely the pile height of these pile loops are greater than their height H before the needle-processing, as can be recognized from comparison of these pile loops with the pile loop 5 shown in dashed lines in FIG. 2. Other pile loops 5*b* which are not engaged by the needles, i.e., are located in the region without needle stitch or engagement and connected with the engaged pile loops 5a by the respective base loops 6, are reduced in the height relative to the initial pile height H. This reduction of the pile height of the not engaged pile loops 5b is performed because during the increase of the pile height of the engaged pile loops 5a, a portion of the pile yarn 1 from at least one not engaged pile loop 5b is pulled or yields through the respective common base loop. The pile heights of the pile loops 5a and the pile loops 5b** are thereby changed relative to one another.

It is thereby a textile flat structure 8 is obtained whose upper side 9 has non-uniform different pile heights which are distributed non-uniformly or irregularly, for example arbitrarily. During needle-processing a shape change of the pile loops 5 of FIG. 1 takes place, as shown for the engaged pile loops 5a. By engagement and pushing the pile loops 5, the needles can influence and more or less change the shape of the pile loops, for example to make it non-uniform. The pile yarn 1 is engaged more or less lightly so that fiber bundles 10 are formed on the pile loops 5a. This is favorable, for example, for formation of a textured or structured upper surface and imparts to a product, for example, the appearance of a natural fiber material, when the pile yarn 1 is composed, for example, of a synthetic fiber material. The construction of the engaged pile loops 5a depends, for example, on the type of the pile yarn or the original pile loops 5, for example, their arrangement and density, or on the conditions of the needle-processing, for example, the type of the needles. The textile flat structure 8 has thus a texture and/or pattern which is impressed because of the different pile heights of the pile loops 5a and 5b, as well as because of the non-uniform shape of the pile loops 5a.

Figure 3:
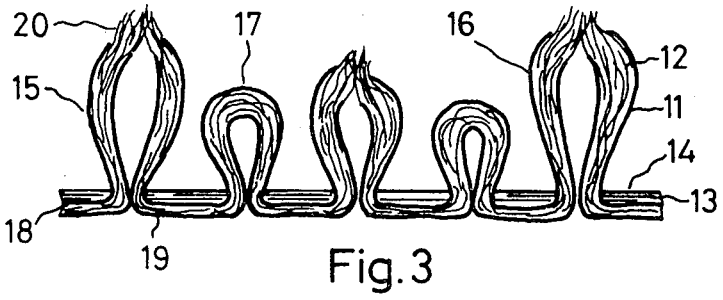
FIG. 3 is a view similar to FIG. 1, but showing a flat structure with further modified pile height and shape.

In a textile flat structure 11 shown in FIG. 3, a pile yarn is tufted into a carrier layer 13. Pile loops 16 and 17 project at an upper side 14 of the carrier layer 13 and forms an upper layer 15. The pile loops 16 and 17 are connected with each other by base loops 19 at a lower side 18 of the carrier layer. After tufting the pile yarn 12 and obtaining the product shown in FIG. 1, the needles are pushed through the carrier layer 13 as described in connection with FIGS. 1 and 2. Thereby, the pile loops 16 and 17 assume different pile heights. During the needle-processing, the pile loops corresponding to the pile loops 16 are engaged by the needles and increased in their height. Not engaged pile loops corresponding to the pile loops 17 are thereby reduced in their height, namely pulled in direction toward the carrier layer 13. The pile loops 16 obtain by the needle-processing an irregular shape and fiber bundles 20 which can be produced by engagement with the needles, as described in connection with the embodiments of FIGS. 1 and 2. Because of the irregular shape, it is obtained, in addition to the different and arbitrarily irregularly distributed pile heights, a texture which imparts to the textile flat structure 10, for example torn, ribbed or roughened appearance.

Figure 4:
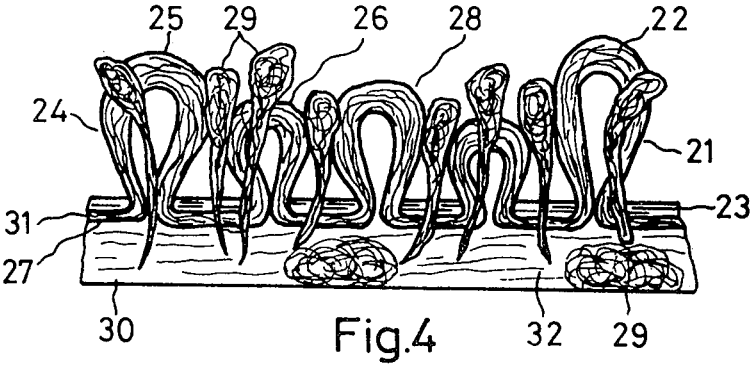
FIG. 4 is a view similar to FIG. 1, but showing a still further modified tufted textile flat structure.

FIG. 4 shows a textile flat structure 21 with a pile yarn 22 which is tufted, so that an upper layer 24 is provided, which has pile loops 25 and 26 connected by base loops 27. The tufted product is needle-processed by insertion of needles through the carrier layer 23, as in the embodiments described in connection with FIGS. 1 and 2, wherein the initial tufted product of FIG. 1 can be utilized. The pile loops 25 engaged by the needles have a greater pile height than the pile loops 26 not engaged by the needles. The pile loops 25 are distributed in the upper layer 24 advantageously arbitrarily and irregularly and have different pile heights, which is also true with respect to the not engaged pile loops 26. The different pile heights of the pile loops 25 and 26 are non-uniformly or irregularly distributed, so that an irregular texture or a texture and/or pattern with irregular appearance is obtained.

Definite fiber structures formed by ball yarns 29 of spherically intertwined fibers or threads lie between the pile loops 25 and 26 and also at and on an upper side 28 of the upper layer 24. For introducing the ball yarns 29, a lower layer 30 is placed into a lower side of the carrier layer 23, after the needle-processing of the tufted product, i.e., after obtaining of the pile loops 25 and 26 with the different pile height. The ball yarns 29 are embedded in a fiber material 32 of the lower layer 30. The ball yarns 29 are engaged by the needles and pushed through the carrier layer 23, for example, in a packet-like way. During engagement by the needles and forcing through the carrier layer 23, tail-shaped or neck-shaped bundles 32 are produced with which the ball yarns 29 remain anchored in the lower layer 30 and the carrier layer 23 and thereby fixed. The introduction of the definite fiber structures is described in the above-mentioned CH-PS to which the reference is made herein.

The ball yarns 29 can fill or complete, for example empty spaces between the pile loops 25 and 26 or over the pile loops 26 with the smaller pile height. The textile flat structure has thereby a texture and/or pattern embossed by combination of the different pile heights of the pile loops 25 and 26 with the introduced ball yarns 29. By the needle-processing for obtaining the pile loops 25 and 26 with different pile heights and the introduction of the ball yarns 29 into the upper layer 24, versatile new textures and/or patterns are produced.

For the sake of clarity, the pile loops in FIGS. 1–4 and the limited fiber structures in FIG. 4 are shown in a schematic manner. In practice, they can be distributed with other distances from one another and have other dimensions and arranged more or less dense relative to one another.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. A method of manufacturing a textile flat structure with a texture and/or pattern on its upper side, comprising the steps of providing a carrier layer having a lower side and an upper side;

tufting said carrier layer with a pile yarn having pile loops and base loops, so that said pile loops project from said upper side of said carrier layer and form an upper layer, whereas said base loops extend at said lower side of said carrier layer;

changing individual projecting pile loops of said pile yarn with regard to their pile height and shape, by needles pushed through said carrier layer and engaging said individual pile loops; and drawing at least one pile loop which is connected with said engaged pile loops by a respective one of said base loops and not engaged by the needles, in direction toward said carrier layer.

2. A method as defined in claim 1, wherein said changing step includes increasing the pile height of said engaged pile loops, and said drawing step includes decreasing the pile height of said at least one not engaged pile loop so that a portion of said pile yarn, which is required for increasing the pile height of said engaged pile loops is drawn through the respective base loop from said at least one not engaged pile loop.

3. A method as defined in claim 1, wherein said changing step includes imparting to said engaged pile loops a non-uniform shape.

4. A method as defined in claim 3, wherein said imparting step includes tearing of said engaged pile loops of said pile yarn.

5. A method as defined in claim 3, wherein said imparting step includes ribbing of said engaged pile loops of said pile yarn.

6. A method as defined in claim 3, wherein said imparting step includes roughening of said engaged pile loops of said pile yarn.

7. A method as defined in claim 1, wherein said changing step includes increasing the pile height of said engaged pile loops so that the latter assume a non-uniform length.

8. A method as defined in claim 1, wherein said changing step includes engaging said pile loops with a needle density of between 5 and 80 stitches per square centimeter.

9. A method as defined in claim 8, wherein said changing step includes engaging said pile loops with a needle density of between 20 and 30 stitches per square centimeter.

10. A method as defined in claim 1, wherein said changing step includes engaging of 20–30% of said pile loops per square meter of the web.

11. A method as defined in claim 1, wherein said tufting step includes tufting with said pile yarn having said pile loops of a predetermined initial height, said changing step including increasing the pile height of said engaged pile loops by 20–100% of their initial height.

12. A method as defined in claim 1, wherein said tufting step includes tufting said pile yarn into said carrier layer by successive working steps, said changing step including thereafter increasing at least the pile height of said pile loops by the needles extending from said rear side of said carrier layer.

13. A method as defined in claim 1; and further comprising the steps of providing a lower layer located under said carrier layer and composed of a fiber material and bringing by needles said fiber material from said lower layer into said upper layer so as to fill at least some spaces in said upper layer with definite fiber structures, after said changing step.

14. A method as defined in claim 13, wherein said changing step includes reducing the pile height of said pile loops, said bringing step including introducing said definite fiber structures into said upper layer at locations corresponding to said height-decreased pile loops.

15. A method as defined in claim 13, wherein said bringing step includes bringing said definite fiber structures in form of ball yarns composed of spherically intertwined fibers.

16. A method as defined in claim 13, wherein said bringing step includes bringing said definite fiber structures in form of ball yarns composed of spherically intertwined threads.

17. A textile flat structure with a texture and/or pattern at its upper side, comprising a carrier layer having an upper side and a lower side a pile yarn tufted in said carrier layer and having pile loops projecting from said upper side of said carrier layer and forming an upper layer, and base loops extending at said lower side of said carrier layer, and wherein some of said pile loops had been engaged by needles and pushed through said carrier layer thereby said upper layer having at least non-uniform different pile heights; and a lower layer arranged below said carrier layer and composed of a fiber material extending from said lower layer through said carrier layer into said upper layer so that said pile loops of said upper layer are mixed with definite fiber structures extending from said lower layer into said upper layer and anchored in at least one of said lower layer and carrier layer.

18. A textile flat structure as defined in claim 17, wherein said pile loops of different pile heights are non-uniformly distributed over said upper side of said carrier layer.

19. A textile flat structure as defined in claim 18, wherein said pile loops of different pile heights are arbitrarily non-uniformly distributed over said upper side of said carrier layer.

20. A textile flat structure as defined in claim 17, wherein 20–30% of said pile loops per square meter have a greater pile height than remaining pile loops of said upper layer.

21. A textile flat structure as defined in claim 17, wherein the pile loops having a greater pile height than the remaining pile loops of said upper layer are of a non-uniform shape.

22. A textile flat structure as defined in claim 21, wherein said some pile loops of said upper layer have a torn shape.

23. A textile flat structure as defined in claim 21, wherein said some pile loops of said upper layer have a ribbed shape.

24. A textile flat structure as defined in claim 21, wherein said some pile loops of said upper layer have a roughened shape.

25. A textile flat structure as defined in claim 17, wherein said fiber structures which extend from said lower layer through said carrier layer into said upper layer are anchored in both said lower layer and said carrier layer.

26. A textile flat structure as defined in claim 17, wherein said fiber structures are arranged between said pile loops of said upper layer.

27. A textile flat structure as defined in claim 17, wherein said fiber structures are arranged on said pile loops of said upper layer.

28. A textile flat structure as defined in claim 17, wherein said upper layer has an upper side, said fiber structures extending at said upper side of said upper layer.

29. A textile flat structure as defined in claim 17, wherein said fiber structures are ball yarns composed of spherically intertwined fibers.

30. A textile flat structure as defined in claim 17, wherein said fiber structures are ball yarns composed of spherically intertwined threads.

31. A textile flat structure as defined in claim 17, wherein said fiber structures include some fiber structures arranged in said upper layer between said pile loops, and other fiber structures arranged in said lower layer and having a construction differing from that of said first-mentioned fiber structures.

* * * * *